United States Patent [19]

Dressler

[11] 4,058,294

[45] Nov. 15, 1977

[54] APPARATUS FOR HAULING A FLEXIBLE, TEXTILE OR METAL ROPE, CABLE OR THE LIKE

[76] Inventor: Bruno Jean-Marie Dressler, 3, avenue Leon Bourgain, Courbevoie, France, 92400

[21] Appl. No.: 677,756

[22] Filed: Apr. 16, 1976

[30] Foreign Application Priority Data

Apr. 18, 1975 France ..... 75.12091

[51] Int. Cl.[2] ..... B66D 1/00

[52] U.S. Cl. ..... 254/167; 24/136 A; 188/65.4; 226/186; 254/175.5; 254/186 HC

[58] Field of Search ..... 254/161, 164, 175.5, 254/138, 186 HC, 191-194, 197, 154, 155, 167, 168; 226/186; 188/65.4, 65.3, 65.5, 77 R; 24/136 A, 115 L, 244, 196, 171

[56] References Cited

U.S. PATENT DOCUMENTS

| | | | |
|---|---|---|---|
| 506,707 | 10/1893 | Matts | 188/65.3 |
| 2,526,935 | 10/1950 | Coker | 188/77 R X |
| 2,619,201 | 11/1952 | Crookston | 188/77 R X |
| 3,516,642 | 6/1970 | Pomagalski et al. | 254/175.5 X |
| 3,622,689 | 11/1971 | Sparks | 254/191 X |
| 3,643,921 | 2/1972 | Puretic | 254/192 X |
| 3,776,517 | 12/1973 | Davis et al. | 254/175.5 X |
| 3,868,089 | 2/1975 | Lindsey et al. | 254/193 X |

FOREIGN PATENT DOCUMENTS

| | | | |
|---|---|---|---|
| 93,333 | 7/1896 | Germany | 188/65.4 |

*Primary Examiner*—Robert J. Spar
*Assistant Examiner*—Donald W. Underwood
*Attorney, Agent, or Firm*—Dennison, Dennison, Meserole & Pollack

[57] ABSTRACT

The present invention relates to an apparatus for hauling a flexible, textile or metal rope, cable, or the like with positive friction drive, having a connection, a pulley for driving the cable by friction, a pressure roller applying the cable on the groove of the pulley, and mechanical means for connecting the connection to the pressure roller and transmitting to the pulley and to the cable the pull due to the load solely by means of the pressure roller, the assembly constituted by the connection, the pressure roller and the mechanical means connecting them being movable with respect to the pulley. The apparatus may serve as a self-lifting device for raising a person or a load along a cable or as fixed hoisting gear.

6 Claims, 7 Drawing Figures

FIG. 1
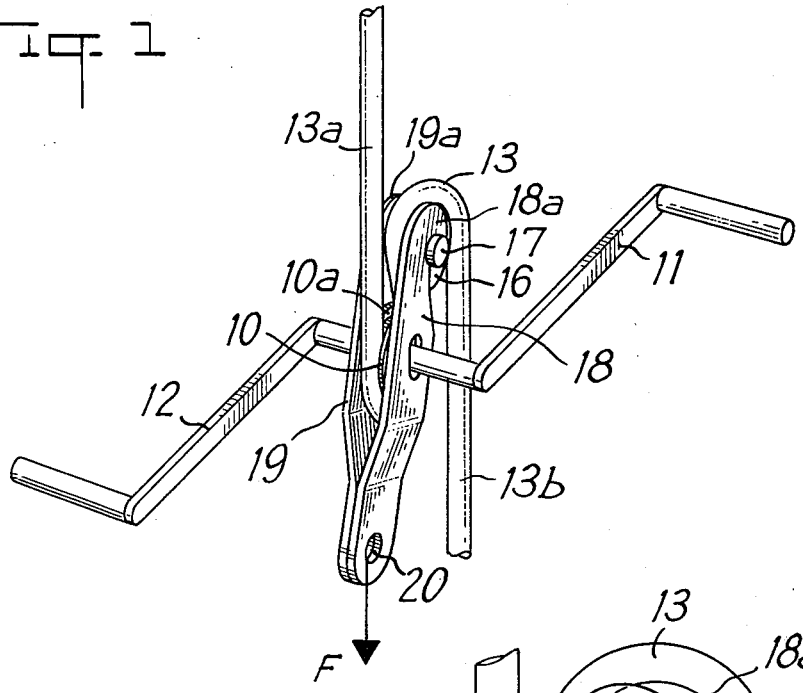
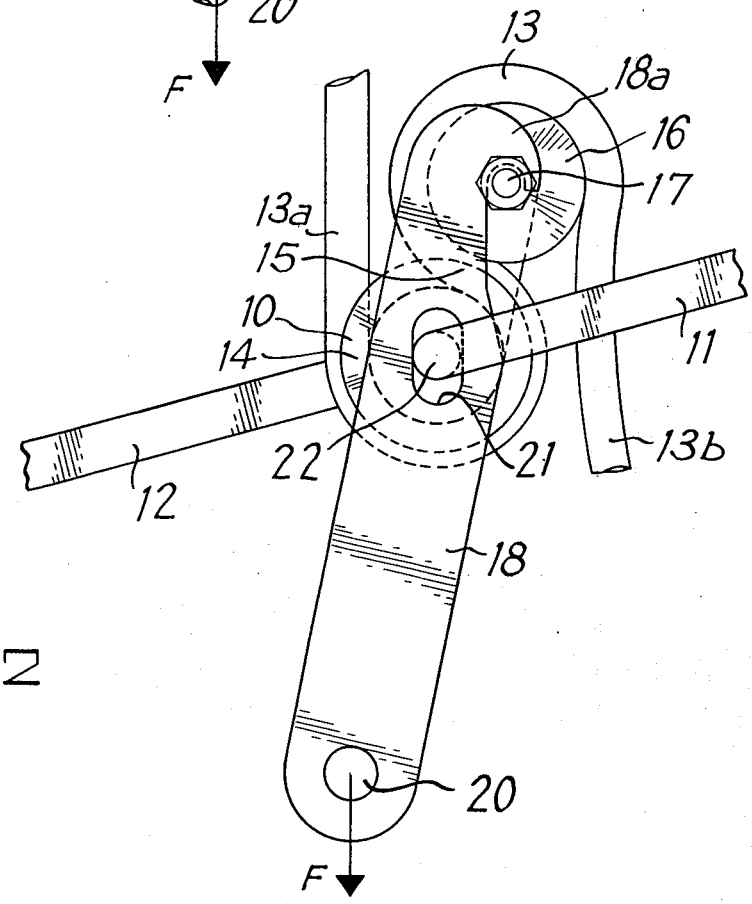
FIG. 2

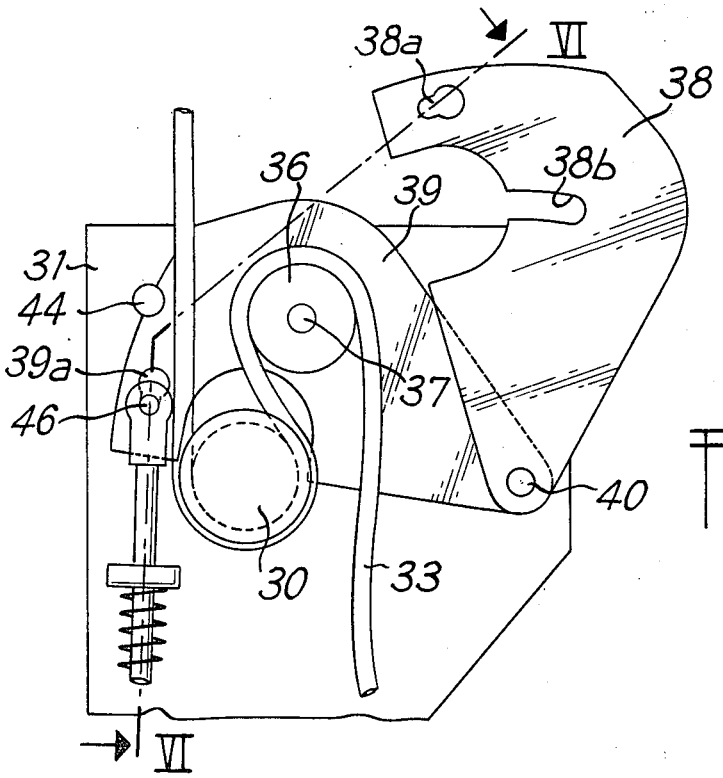
FIG. 5
FIG. 6
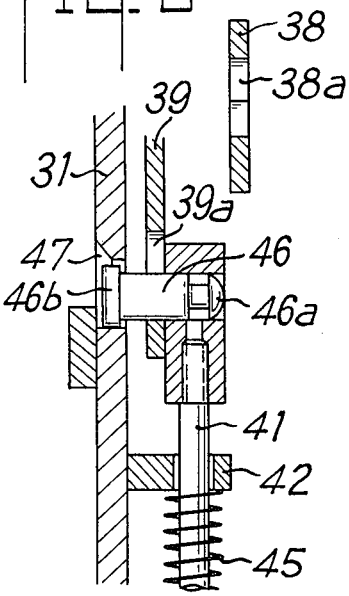
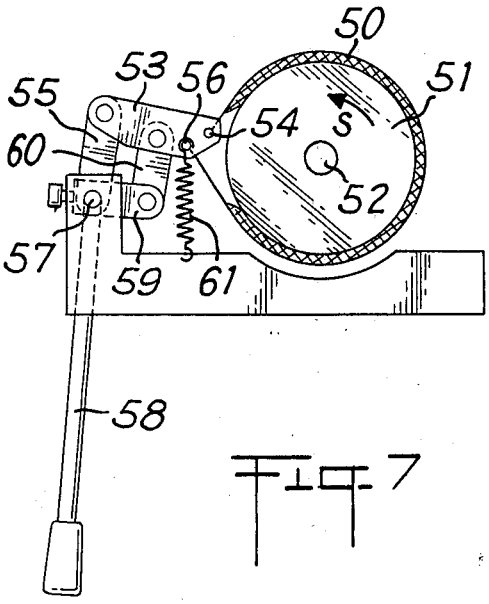
FIG. 7

APPARATUS FOR HAULING A FLEXIBLE, TEXTILE OR METAL ROPE, CABLE OR THE LIKE

The present invention relates to an apparatus for hauling a flexible, textile or metal rope or cable, with positive friction drive, of the type comprising a connection, a pulley for driving the cable by friction, the cable being wound in the groove of the pulley between an entrance point and an exit point, a pressure roller movable with respect to the pulley and pressing the cable against the groove of the pulley at the exit point of the cable and means for applying the pressure roller against the cable.

In known apparatus of this type, the pressure roller exerts its bearing force on the cable by means of springs or counterweights. The devices with springs and counterweights render these apparatus complicated, generally do not enable the cable to be easily positioned nor removed and do not transmit to the pressure roller a strain which is a function of the load applied to the apparatus.

To remedy these drawbacks, it has been proposed to transmit to the pressure roller a part of the tension of the taut loaded part of the cable, particularly by means of a roller interposed on the path of the taut part of the cable and connected to the pressure roller by a lever arm. However, this device makes it necessary to provide for an element enabling part of the tension of the cable to be diverted and the taut part of the cable does not extend freely from its point of entrance on the drive pulley. It has also been proposed to apply to the pressure roller a part of the strain exerted on the connection by means of a bent lever carrying at its ends the pressure roller and the connection and articulated between its ends on the framework of the apparatus.

In these two latter cases, only a part of the strain exerted on the cable or the connection is transmitted to the pulley by the pressure roller. This results in a considerable part of the main pull being exerted on the shaft of the drive pulley and not being used to increase the friction of the cable against the pulley. Furthermore, it is then necessary to provide for bearings for supporting the shaft of the pulley and means for driving this latter allowing the presence of such a radial force exerted on the shaft of the pulley.

It is an object of the invention to provide an apparatus not having these drawbacks, using the main pull to a maximum to convert it into bearing force of the pressure roller on the cable and being able to avoid the application of part of the main pull on the shaft of the drive pulley.

To this end, in the apparatus according to the invention, there are provided mechanical means for connecting the connection to the pressure roller and for transmitting to the drive pulley and to the cable the pull applied to the connection, solely by means of the pressure roller, the assembly constituted by the connection, the pressure roller and the mechanical means connecting them being movable with respect to the drive pulley.

The invention will be more readily understood on reading the following description with reference to the accompanying drawings, in which:

FIG. 1 schematically shows a perspective view of a first, simplified embodiment of an apparatus according to the invention.

FIG. 2 shows a part side elevation view on a larger scale of the apparatus shown in FIG. 1.

FIG. 5 shows a part side elevation view of the apparatus shown in FIG. 3, but in rest position and showing the mode of introduction of removal of the cable.

FIG. 6 shows a part view in section along line VI—VI of FIG. 5, and

FIG. 7 shows a part view in side elevation and in section showing a non-return device and descent brake of the means driving the pulley of the apparatus shown in FIG. 3.

Figure 3:
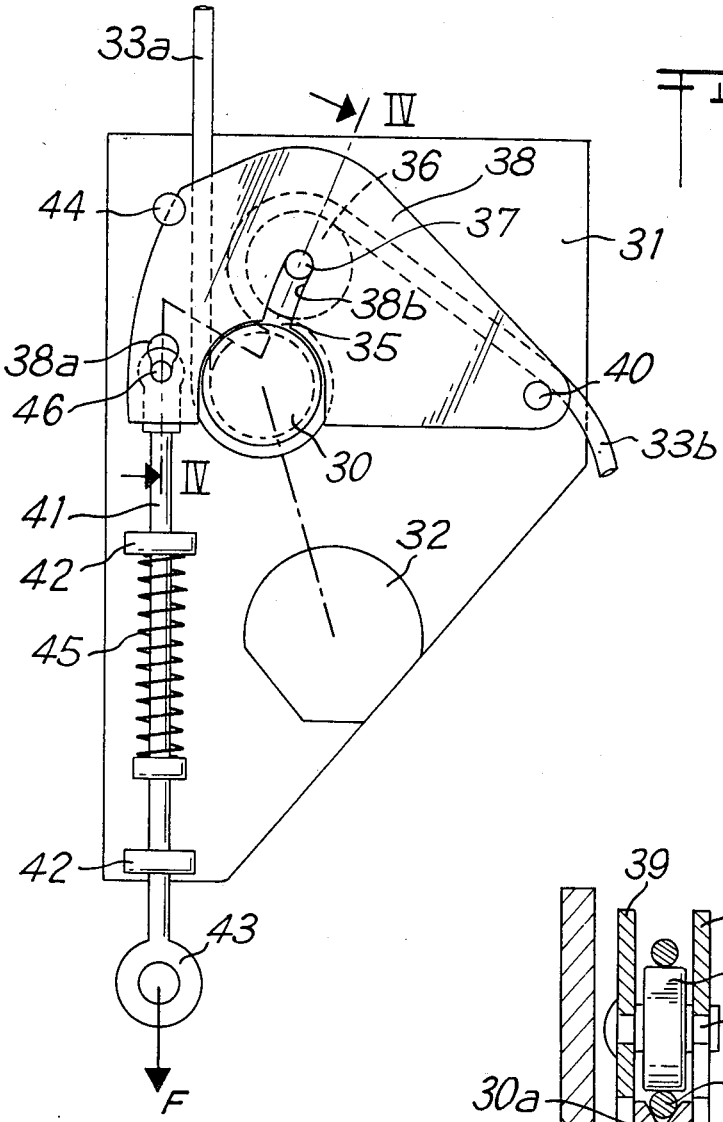
FIG. 3 shows a side elevation view of a second embodiment of an apparatus according to the invention, in operating position.

Referring now to the drawings, FIGS. 1 and 2 illustrate a simplified embodiment of the hauling apparatus according to the invention.

A drive pulley 10 is rotated by cranks 11, 12 and drives a flexible cable 13 by friction. The cable 13 is wound over a part of the circumference of the groove 10*a* of the pulley 10 between an entrance point 14 of the cable, whence extends the part 13*a* of cable taut under the effect of a load to be hauled, and an exit point 15 of the cable, whence extends the part 13*b* of slack cable.

A pressure roller 16 whose axis is parallel to the axis of rotation of the pulley 10, is mounted to rotate freely on a shaft 17 carried by two side plates 18, 19 and fast with these side plates. At their ends opposite those carrying shaft 17, the side plates 18, 19 have a fixing hole 20 constituting the connection of the apparatus.

An aperture 21 is formed in each of the side plates 18, 19 in order to allow passage of the shaft 22 of the drive pulley 10 and to allow the relative movement of the side plates and of the pulley in a direction substantially parallel to that of the part 13*a* of taut cable.

The pull F due to the presence of a load to be hauled, and applied to the connection 20 is therefore totally transmitted to the pulley 10-cable 13 assembly solely by the pressure roller 16. The drive pulley 10 is then practically subjected to a pure couple of forces composed of the bearing force of the pressure roller and the tension exerted on the cable 13, and this pulley therefore has to withstand practically no radial strain, this at the most making it possible to do without a support bearing for the pulley.

In their parts 18*a*, 19*a* supporting the shaft 17 of the pressure roller 16, the side plates 18 and 19 are in hook form. In this way, by displacing the side plate 18 in a direction substantially opposite that of the pull applied to the connection 20, the pressure roller may be disengaged by rotation of the side plate 18 about the axis 22 and the cable 13 thus engaged or disengaged.

A device forming non-return, for example a stop lug (not shown) may be mounted on the path of the part 13*a* of taut cable.

The apparatus shown in FIGS. 1 and 2 may be used as self-lifting apparatus for a person suspended from the connection 20. This apparatus may also be used as hoisting gear for lifting a load suspended from part 13*a* of taut cable, the connection being fixed.

FIG. 3 illustrates a preferred embodiment of an apparatus according to the invention.

A drive pulley 30, supported by a frame 31, is rotated by a motor 32 and a speed reducer (not shown). A cable 33 is wound over a part of the groove of the pulley 30 between an entrance point of the cable, whence extends the part 33*a* of the cable taut under the effect of a load to be hauled, and an exit point of the cable, whence extends the part 33*b* of the slack cable.

Figure 4:
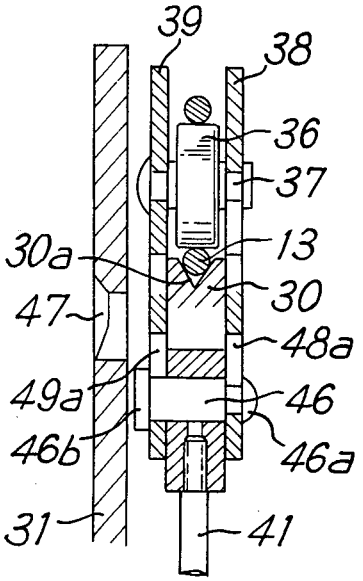
FIG. 4 shows a part view in section along line IV—IV of FIG. 3.

A pressure roller 36 is mounted to rotate freely about a shaft 37 fast with two side plates 38, 39 (FIGS. 3, 4). On one side of the pulley 30, the side plates 38, 39 are articulated about an axis of articulation 40 parallel to the axis of rotation of the pulley 30 and fast with the frame 31 which supports the bearing (not shown) of the drive pulley. On their other side, with respect to the pulley 30, the side plates 38, 39 are connected to an end of a rod 41 mounted to slide in guides 42 fast with the frame 31 and bearing a fixing ring, or connection 43, at its other end.

The main pull F is transmitted to the pulley 30 and to the cable 33 solely by the pressure roller 36 and the assembly constituted by the connection 43, rod 41, side plates 38, 39 and the pressure roller 36 is movable with respect to the pulley in a direction substantially parallel to that of the part 33*a* of the taut cable.

The side plates 38 and 39 form a lever transmitting the whole of the main pull and, as in the case of the embodiment shown in FIGS. 1 and 2 and against a suitable choice of the characteristics of the lever, the pulley 30 may practically be subjected only to the action of a pure couple.

As is shown in FIG. 3, the side plates 38 and 39 envelope the pulley 30 on each side and thus prevent the cable 33 from escaping sideways. The side plates 38, 39 are held by a spacer member 44 having grooves in which the edges of these side plates engage.

A spring 45 mounted on the rod 41 abuts on a guide 42 and exerts on the rod 41 a strain tending to apply to the pressure roller 36 an initial bearing force, in the absence of pull, so as at least to counterbalance the effect of the weight of the apparatus so that said latter holds on the cable 33 in absence of load.

The side plate 38 may advantageously be entirely disengaged to facilitate the introduction and removal of the cable, as illustrated in FIGS. 5 and 6.

The side plates 38 and 39 are connected to the rod 41 by a shaft 46 engaged in apertures 38*a* and 39*a* in side plates 38 and 39, when the apparatus is in operating position. The shaft 46 is furthermore mounted to slide at the end of the rod 41 in a direction perpendicular to the side plates 38 and 39.

The aperture 38*a* is in the form of a key hole. By pressing on the rod 41 to compress the spring 45, the head 46*a* of shaft 46 is brought to the level of the enlarged part of the opening 38*a*. The shaft 46 may then slide and be disengaged from the side plate 38, the end part 46*b* of the shaft 46 opposite its head 46*a* penetrating into a housing 47 made in the frame 31 (FIG. 6). If the strain exerted on the rod 41 is then slackened, the spring 45 maintains the end part 46*b* of the shaft 46 engaged in the housing 47. The side plate 39 is then lifted and maintains the pressure roller 36, with which it remains fast, separated from the pulley 30 whilst the side plate 38 may be completely disengaged by rotation about the axis 40 (FIG. 5), the side plate 38 having an open aperture 38*b* enabling it to be disengaged from the shaft 37 of the roller 36. The apparatus is therefore in position of engagement or disengagement of the cable, this operation being effected manually in a few seconds. Furthermore, with this arrangement, the risks of accidental opening of the side plate 38 are eliminated.

The drive pulley 30 preferably comprises a removable sheave adapted to the cable used. In this way, for metal cables, a sheave with wedge groove, of trapezoidal radial section and small wedge angle is used. For textile ropes, a sheave with rounded and fluted groove is used. The apparatus according to the invention may therefore be used both for textile ropes and for metal cables, provided that the sheave of the pulley is changed.

The motor 32 is a thermal engine for example of the type such as used for chain saws, and transmits the drive force to the drive pulley by means of a reversible speed reducer. Such a motor is provided with a centrifugal clutch which ensures the mechanical connection only when the speed of rotation of its driven shaft exceeds a determined value.

A non-return device, shown schematically in FIG. 7, is provided in the case of stop or slowing down of the motor, translated by a declutching, this non-return device also advantageously serving as descent brake when the loaded apparatus is descending along a cable.

A strap 50 is wound around a drum 51 fast with the driving shaft 52 of the speed reducer. A lever 53 is, at a first end, connected to one end of the strap 50 by an articulation axle 54 and, at its second end, articulated to one end of a link 55. The lever 53 also bears a fastening 56 connected to the other end of the strap 50. At its end opposite the one connected to lever 53, the link 55 is articulated on an axle 57 carried by the frame 31. When the drum 51 rotates in the direction S, there is self-wedging of the strap 50 which fulfills the non-return function. A traction spring 61 connects the fastening 56 to the frame 31 in order to exert an initial traction intended to trigger off the non-return effect. In the direction of drive, opposite direction S, there is unwedging of the strap, the only friction coming from the action of spring 61.

An arm 58 which may be manually pivoted by its free end, is connected at its other end to a lever 59 itself connected to lever 53 by a link 60. By manually actuating the arm 58, the strap 50 may be loosened by means of the link 60 and lever 59. The drum 51 is then released and may freely deflect under the action of a load suspended from the apparatus. The arm 58 therefore constitutes a descent hand brake particularly for descent along a cable of a person suspended from the apparatus.

The hauling apparatus forming the subject matter of the invention is applied to the majority of domains using ropes or metal cables. As self-lifting apparatus, it is applied to pot-holding, mountain rescue, rescue on winter sports equipment. As hoisting gear, it is applied to all the known applications of winch or tackle and more particularly those which require the use of a self-contained means which is rapid to put to use.

What is claimed is:

1. Hoisting apparatus for applying a pulling force on a flexible cable comprising a load connection; a first pulley for driving said cable by friction over a part of its circumference between an entrance point of the cable from which the part of the cable subjected to a tension under the effect of a load to be hauled freely extends, and an exit point of the cable from which the part of cable not subjected to tension extends; means for rotating said drive pulley; a frame supporting said drive pulley and rotating means; a pressure roller freely rotatable about an axis parallel to the axis of rotation of said drive pulley for selectively pressing said cable against said drive pulley, a lever arm having first and second end portions and formed by two spaced side plates between which said pressure roller is mounted intermediate said first and second end portions, said first end portion being pivotally mounted to said frame about an axis parallel to the axis of rotation of said drive pulley; a connecting member slidably connecting said second end portion of said lever arm to said load connection, said connecting member being slidable with respect to said frame in a direction substantially perpendicular to said axis of rotation of the drive pulley and said side plates whereby load force applied to said load connection is transmitted to said pressure roller through said connecting member and side plates.

2. A hoisting apparatus as defined in claim 1, further comprising resilient means for exerting a pre-load on said connecting member so as to transmit to the pressure roller an initial pre-load, in the absence of pull applied to the load connection in order at least to counterbalance the effect of the weight of the apparatus.

3. A hoisting apparatus as defined in claim 2, wherein said connecting member is removably connected to at least one of the side plates to allow the opening of this side plate in order to introduce or remove the cable.

4. A hoisting apparatus as defined in claim 3, wherein said connecting member is a sliding rod having one end portion forming said load connection and a pivot at its other end selectively connected to at least one of the side plates, said pivot being mounted on said rod for limited perpendicular sliding movement with respect to the side plates, a housing formed in the frame, said housing being adapted to selectively receive an end part of said pivot during disengagement of the pivot from said one plate in order to allow the displacement of said one side plate from said rod, and simultaneously to maintain said resilient means compressed and said pressure roller separated from the drive pulley in order to introduce or remove the cable.

5. A hoisting apparatus as defined in claim 1, wherein said side plates envelope the drive pulley and guide the cable entrained around the drive pulley when it is no longer under tension.

6. A hoisting device including a frame, a spaced pair of side plates having first and second ends and being pivotally attached at their first ends to said frame and simultaneously movable between pressure controlling positions with respect to said frame, at least one of said plates being movable with respect to the other and said frame, a drive pulley rotatably mounted on said frame and at least partially disposed between said plates for selective rotation therebetween, drive means connected to said drive pulley, a pressure roller rotatably carried by an axle secured to one of said plates and extending to a point of selective connection with the other of said plates, rod means selectively connectable at one end to said second ends of said plates for limited movement therewith, pre-load spring means operably associated with said rod to urge said rod and said plates and said pressure roller in cne direction, load connecting means disposed at the other end of said rod, cable means including a normally taut portion and a normally slack portion extending between said plates and entrained around said drive pulley and said pressure roller serially in opposite directions whereby a load applied to said load connecting means will be transferred to said cable through said side plates, said drive roller and said pressure roller, and increase the pressure beyond that applied to said cable by said pre-load spring thereby increasing the frictional engagement of said drive roller with respect to said cable.

* * * * *